United States Patent [19]

Næss et al.

[11] Patent Number: 4,962,807

[45] Date of Patent: Oct. 16, 1990

[54] CONTINUOUS OF SEMI-CONTINUOUS CASTING APPARATUS FOR CASTING METALLIC MATERIALS

[75] Inventors: Harald Næss, Sunndalsøra; Jan Sivertsen, Groa, both of Norway

[73] Assignee: Norsk Hydro a.s., Oslo, Norway

[21] Appl. No.: 338,938

[22] Filed: Apr. 17, 1989

[30] Foreign Application Priority Data

Apr. 15, 1988 [NO] Norway ..... 881633

[51] Int. Cl.[5] ..... B22D 11/124; B22D 11/07

[52] U.S. Cl. ..... 164/444; 164/472; 164/486

[58] Field of Search ..... 164/486, 487, 444, 472

[56] References Cited

U.S. PATENT DOCUMENTS

| | | | |
|---|---|---|---|
| 4,597,432 | 7/1986 | Collins et al. | 164/487 |
| 4,598,763 | 7/1986 | Wagstaff et al. | 164/487 |
| 4,693,298 | 9/1987 | Wagstaff | 164/486 |

*Primary Examiner*—Richard K. Seidel

*Attorney, Agent, or Firm*—Wenderoth, Lind & Ponack

[57] ABSTRACT

A continuous or semi-continuous casting apparatus of the direct chill type for casting metallic materials, particularily recctangular ingots of aluminium, includes a mold which has an open inlet for the filling of molten metal into a mold cavity having an open outlet with a water supply for cooling of the metal. The mold cavity is, at a position spaced from its inlet, provided with a permeable ring for the supply of oil and/or gas, such that a layer of oil and/or gas is formed between the metal and mold wall, whereby the metal is prevented from coming into contact with the mold wall before it solidifies. The surfaces of the ring, with the exception of the side facing the mold cavity, are provided with a sealing agent which prevents the oil and/or gas from escaping through such surfaces. Further, the ring, in its circumferential direction, is provided with longitudinal bores or holes which are supplied the oil and/or gas to via further bores extending through the mold wall and into the graphite ring from the outside of the mold.

19 Claims, 3 Drawing Sheets

CONTINUOUS OF SEMI-CONTINUOUS CASTING APPARATUS FOR CASTING METALLIC MATERIALS

BACKGROUND OF THE INVENTION

The present invention relates to continuous or semi-continuous casting apparatus of the direct chill type for casting metallic materials, particularly rectangular ingots of aluminum, comprising a mold cavity which has an open inlet for the filling of molten metal and an open outlet with water supply means for cooling of the metal. The mold cavity, at a position spaced from its inlet, is provided with a permeable ring for the supply of oil and/or gas, such that a layer of oil and/or gas is formed between the metal and the mold wall, whereby the metal is prevented from coming into contact with the mold wall before it solidifies.

It is previously known to supply oil or gas to the mold cavity in the above manner. For example, Norwegian patent application No. 830858 reveals a casting apparatus for ingots where gas and oil is supplied to the mold cavity via a graphite ring which is disposed in the mold wall close to the mold outlet.

Oil and gas is supplied to the graphite ring through separate bores in the outer mold wall e.g. in the form of a sleeve. By means of channels on the outer side of the ring which are connected to the bores in the sleeve, the oil and gas is distributed around the periphery of the ring.

To avoid oil and gas leakage between the ring and sleeve, it is necessary that the ring and sleeve be sealed tight to one another. Thus, the diameter of the graphite ring is machined to a size which is somewhat greater than the diameter of the sleeve. When mounting takes place, the sleeve is heated to expand so that the ring can be placed in its correct position within the sleeve. Further, upon cooling the sleeve will shrink, whereby sealing is achieved between the ring and sleeve. However, this will demand a very fine and accurate machining of the ring as well as the sleeve, and the smallest surface defect or scratch will result in leakage.

With the above demands regarding tolerances and surface roughness, it is obvious that this type of graphite ring is expensive to manufacture and use.

Besides, the above type of ring is hardly applicable for a casting apparatus producing rectangular ingots, primarily because the metal parts of the mold are machined by milling, and secondarily because the graphite "ring" has to have a rectangular configuration, i.e. the sides of the ring (frame) will be deflected inwardly so that it is impossible to use a force bit between the ring and the sleeve.

SUMMARY OF THE INVENTION

It is an object of the present invention to provide a permeable ring, for instance of graphite, for a casting apparatus and which is not encumbered with the above disadvantages, i.e. which is simple and inexpensive to manufacture and which is particularily applicable in a casting apparatus producing rectangular ingots or other types of continuous or semi-continuous cast products where the cross section of the ingot is other than circular.

The ring according to the invention is characterized in that its surfaces, with the exception of the surfaces facing the mold cavity, are provided with a sealing agent which prevents the gas and/or oil from penetrating such surfaces. The ring has therein peripherical bores or holes to which are supplied oil and/or gas via further bores extending through the mold wall and into the graphite ring from the outside.

BRIEF DESCRIPTION OF THE DRAWINGS

The invention will now be further described by way of examples and with reference to the accompanying drawings in which.

DETAILED DESCRIPTION OF THE INVENTION

Figure 1:
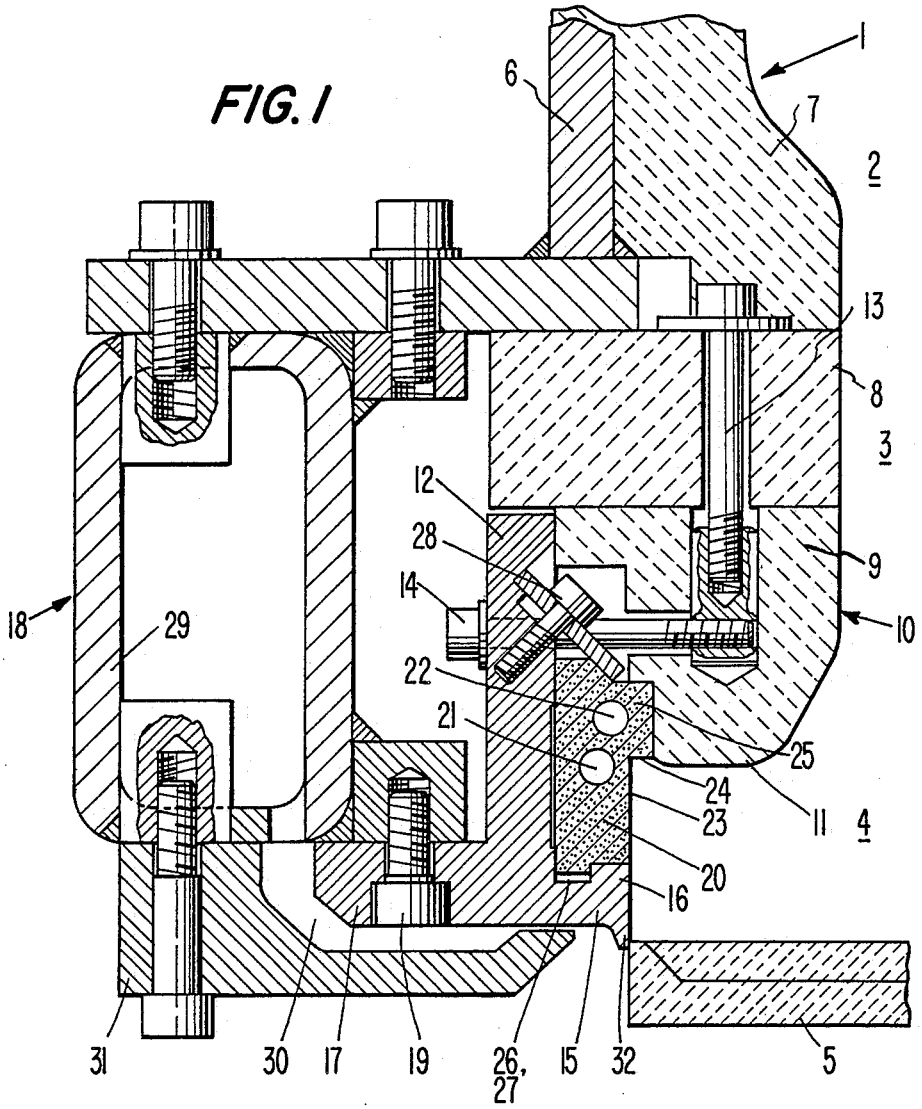
FIG. 1 is a vertical cross section of a side wall of a casting mold for casting rectangular ingots in which a ring according to the invention is used.

As mentioned above, FIG. 1 shows a vertical cross section of a side wall of a casting mold 1 for casting rectangular ingots. Since the ingots have rectangular shape, it will be understood that the casting mold according to this example has four walls, each with an internal configuration as shown in FIG. 1.

The hollow mold cavity comprises an upper upwardly open inlet part 2, an inwardly protruding middle part 3, and a lower mold cavity 4 which is downwardly open and has a length and width relationship corresponding to the cross sectional measurements of the ingot.

At the mold cavity 4 opening, i.e. by the outlet of the mold, is provided a support 5 which is moveable in the vertical direction by means of a piston/cylinder arrangement or the like (not shown). This support seals off the opening of the mold at the beginning of the casting cycle.

The mold inlet wall consists of an outer reservoir frame 6 made of steel, on the inside of which is provided a plate 7 of refractory material. The reservoir frame is further connected to a base frame 18 which is also made of steel.

Beyond the refractory plate 7 are provided additional pieces 8,9 of refractory material forming the middle part of the mold, the so-called "hot-top" 10.

The hot-top 10 forms a narrow pass within the hollow mold in the direction of the metal flow and creates an overhang with a flat part 11 at the inlet of the mold cavity 4.

The refractory pieces are secured to one another by means of a screw connection 13, which in turn is secured to an aluminium/steel sleeve 12 by means of another screw connection 14. The lower end of sleeve 12 is provided with an inwardly protruding projection 15 having an inner surface or side 16 that forms the lower side wall of the mold cavity 4. The sleeve 12 further has an angular configuration including a leg 17 that protrudes outwardly in a direction opposite to the projection 15. The leg 17 and thereby also the sleeve 12 is securely attached to the base frame 18 by means of a screw connection.

Between the projection 15 and the hot-top 10 is provided a permeable ring 20 having an inner side or surface 23 forming the upper wall of the mold cavity. The ring in the present example also is provided with an inwardly extending projection or step 25, having a lower side surface facing downwards positioned somewhat withdrawn (at a higher level) than the horizontal part 11 of the hot-top (approx. 1–2 mm). As employed herein, the term "ring" is not limited to a circular member, but indicates rectangular or other annular, enclosed shapes.

When during the casting process gas is supplied to the ring, a gas cavity is created in this area, thereby providing an isolating layer between the ring and the melt and an even distribution of gas all around the hollow mold periphery.

The permeable ring 20 is further provided with two bores 21,22 in the longitudinal (circumferential) direction of the ring. One of the bores 21, which is slightly on the inside of and below the corner between the hot-top and the mold wall 23, is used for the supply of gas to the ring, while the upper bore 22 is used for the supply of oil to the ring. The oil and gas is supplied to the ring under a certain pressure, and since the sides of the ring, with the exception of the sides 23,24 facing the mold cavity where the metal is present during casting, are sealed, the gas and oil will penetrate the ring from the bores 21,22 and enter into the mold cavity. In FIG. 1, the sides of ring 20 provided with a sealing agent are indicated by somewhat thicker lines.

The lower end of ring 20 is provided with a tongue 27 which corresponds to a groove 26 in the projection 15 of the sleeve. By means of a simple screw-clamping connection 28, the ring is pressed against and securely fastened to the sleeve 12. The base frame 18 is formed of rectangular 29. Water is supplied to the mold through these pipes and further via a slot defined between the sleeve leg 17 and a water slot profile member 31. On the sleeve projection 15 is provided a downwardly protruding tongue 32 which deflects the water jet and leads it downwards and inwardly towards the metal being cast.

The preformance of a casting operation is as follows. The support 5 is stationed in its upper position sealing off the outlet of the mold. Oil and gas is supplied to the ring 20, simultanously with a water supply valve being opened. Metal melt, for instance aluminum, can now be filled into mold inlet 2.

As soon as the lower part of such metal begins to solidify, the support 5 may be lowered. Very soon a gas cavity is created along the periphery of the mold at the corner below the hot-top 10, and as the metal flows downwards, a gas and oil film or layer is provided between the metal and the mold wall.

As the walls of the mold cavity define a rectangular opening, an ingot with rectangular cross section is produced. The casting cycle is stopped when the support has reached its lowermost position.

Casting of the above described type is to be denoted semi-continuous casting. Casting does not take place only in one mold at a time, but in several molds simultaneously, as the molds are interconnected in groups.

Figure 2:
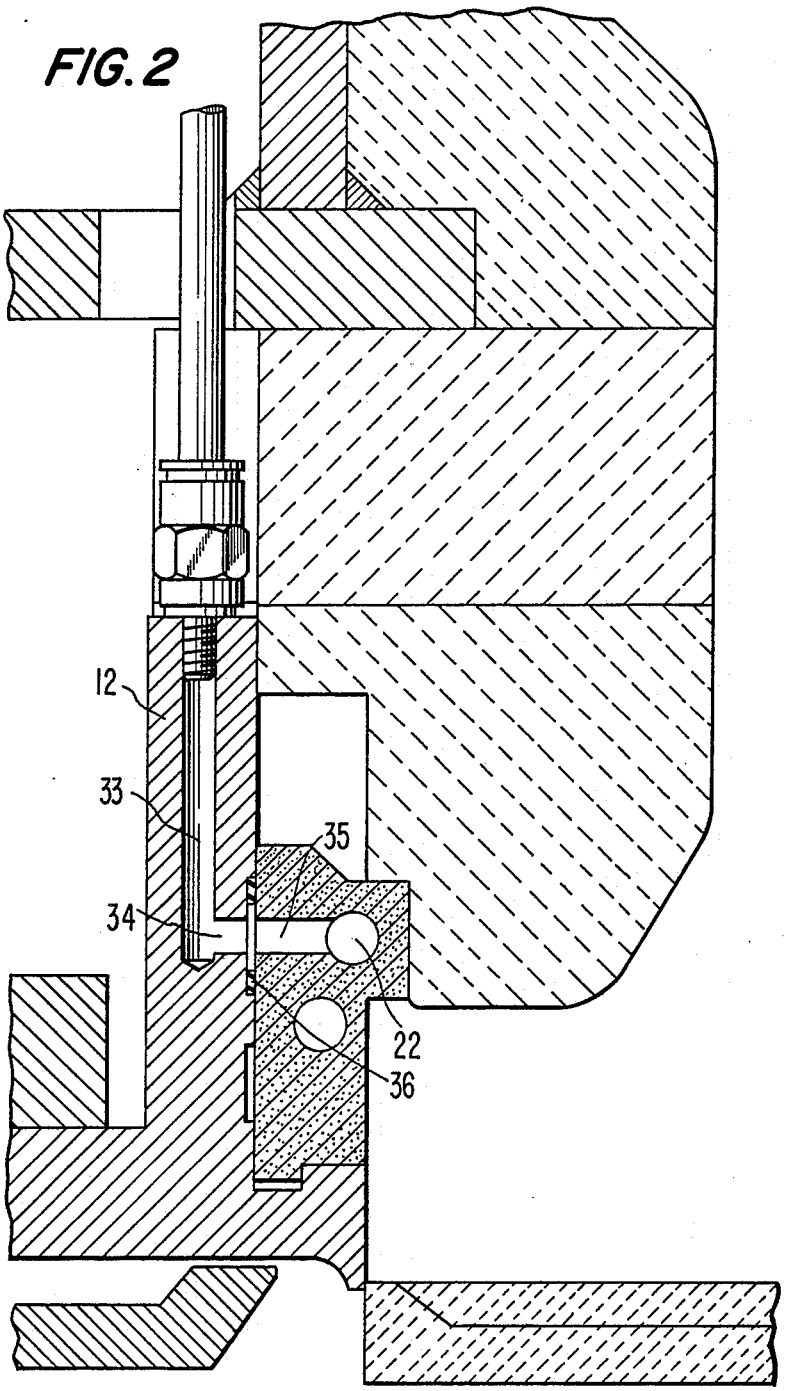
FIG. 2 is another vertical cross section thereof.

FIG. 2 shows a cross section of the mold wall in an area where the oil is supplied to the permeable ring 20. As will be appearant from FIG. 2, the oil is supplied through bores 33,34 in the sleeve 12 and further via a transverse bore 35 in the ring extending to the bore 22.

Between the ring 20 and sleeve 12 is provided a gasket (seal ring) 36 which prevents the oil from entering into the space between the sleeve and the ring. A corresponding arrangement (not shown) is provided for the supply of gas to the other bore 21.

Figure 3:
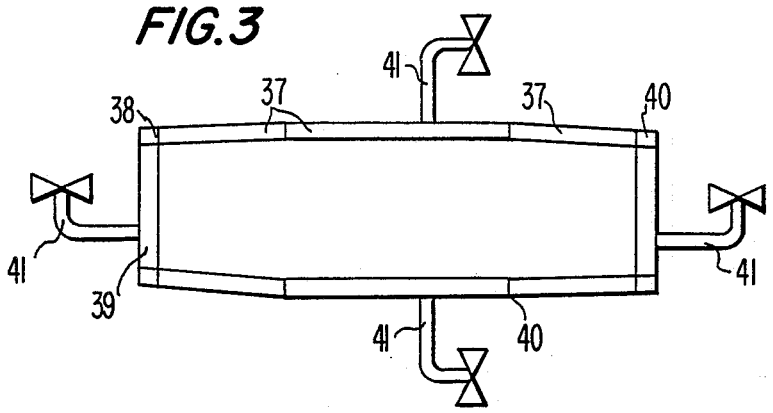
FIG. 3 is a plain view of the ring, in a smaller scale, from above.

FIG. 3 shows the ring 20 on a smaller scale, as seen from above. The ring is composed of several elements being glued to one another at their transverse ends 40. In this example, the ring consists of six long side elements 37, two short end elements 39 and four corner elements 38. The oil and gas supply is provided by members 41 connected to the ring. As can be seen, the oil and gas is supplied to each of the long sides and each of the short ends.

Though FIG. 3 shows a permeable ring made of several elements, it is obviously possible, within the scope of the invention, to make the ring from one single piece of permeable material. Further, it is obvious that the ring according to the invention can have other cross sections than what is shown in FIGS. 1 and 2, and can be used for casting other ingot shapes than the one previously mentioned.

Figure 4:
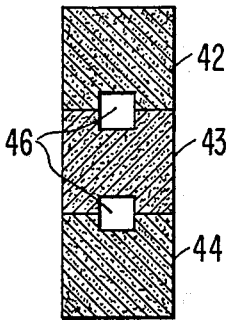
FIG. 4 is a cross section of an example of a circular ring composed of ring elements.
Figure 5:
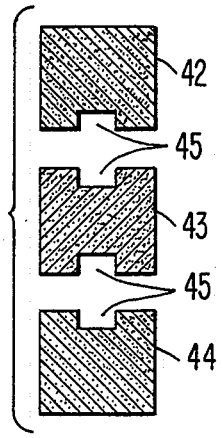
FIG. 5 is an exploded sectional view of the different ring elements of which the ring according to FIG. 4 is composed.

In FIGS. 4 and 5 is shown the cross section of circular ring assembled by means of gluing, and which is used in a casting apparatus for casting ingots of circular shape. The ring is made of ring elements 42,43,44 being provided with grooves 45 which after the assembly form rectangular (or circular) holes (bores) 46 in the ring.

Figure 6:
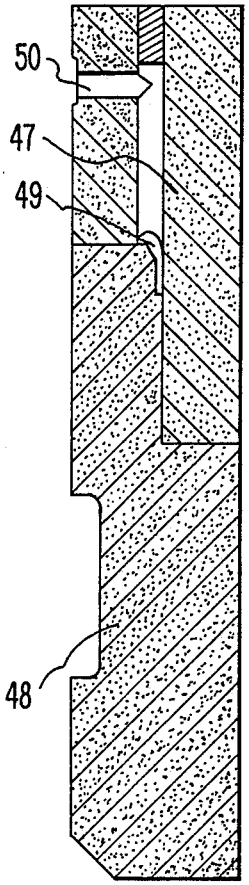
FIG. 6 is a cross section of a ring made of ring elements.

FIG. 6 shows another example of a permeable ring made of two ring elements, including an upper ring element 47 partly overlapping a lower ring element 48. The two elements 47,48 are attached to one another by means of gluing.

A slit 49 is provided between the two ring elements in their peripherical direction for the supply of oil to the ring via two diametrically arranged bores 50 (only one bore is revealed in FIG. 6). The overlapping provides a more even oil distribution throughout the ring.

Gas may be supplied to the ring element 47 through a groove 50 extending along the circumference of the ring.

We claim:

1. A continuous or semi-continuous casting apparatus of the direct chill type for casting metallic materials, particularly metal ingots, said apparatus comprising:

a mold defining a mold cavity with an open inlet for the introduction of molten metal, an open outlet for withdrawal of solidified metal, and coolant supply means for supplying coolant adjacent said outlet for cooling metal;

a ring, formed of a material that is permeable to at least one of oil and gas, mounted in said mold at a position spaced from said inlet, said ring having a plurality of surfaces including at least one first surface facing and defining a portion of said mold cavity;

at least one annular bore formed in said ring and extending through said ring throughout the entire annular dimension thereof;

at least one hole extending through said ring from the exterior thereof and opening into said annular bore, such that at least one of oil and gas may be supplied from the exterior of said mold to said hole and then to said annular bore, whereby such at least one of oil and gas passes through said material of said ring and enters said mold cavity through said at least one first surface of said ring to form a layer between the metal within said mold cavity and the wall of said mold to prevent the metal from contacting said wall before the metal solidifies; and all of said surfaces of said ring other than said at least one first surface thereof being covered with a sealing agent prevention the escape therethrough of the at least one of oil and gas.

2. An apparatus as claimed in claim 1, wherein said ring has therein plural said annular bores.

3. An apparatus as claimed in claim 2, comprising two said annular bores.

4. An apparatus as claimed in claim 2, wherein said ring has therein plural said holes, each said hole opening into a respective one only of said annular bores.

5. An apparatus as claimed in claim 4, wherein each said annular bore has opening thereinto a plurality of said holes.

6. An apparatus as claimed in claim 1, wherein said mold includes, at a position slightly above said ring, an inwardly protruding portion, and said ring is positioned adjacent a corner defined between said inwardly protruding portion and a wall of said mold cavity therebelow.

7. An apparatus as claimed in claim 6, wherein said ring has formed therein two said annular bores including an upper bore for the supply thereto of oil and a lower bore for the supply thereto of gas.

8. An apparatus as claimed in claim 6, wherein said ring includes an upper portion extending upwardly at least to the level of said corner.

9. An apparatus as claimed in claim 8, wherein said ring includes an inwardly extending step defining said upper portion of said ring.

10. An apparatus as claimed in claim 9, wherein said step has a downwardly facing surface forming one said first surface.

11. An apparatus as claimed in claim 10, wherein said downwardly facing surface of said step of said ring is at a level no lower than a lower face of said inwardly protruding portion of said mold.

12. An apparatus as claimed in claim 9, wherein said upper bore is formed in said upper portion of said ring, at a position above a corner defined between said step and a lower portion of said ring, and said lower bore is formed in said lower portion of said ring.

13. An apparatus as claimed in claim 1, further comprising clamping means for mounting said ring in said mold.

14. An apparatus as claimed in claim 13, wherein said clamping means comprises a single clamping member.

15. An apparatus as claimed in claim 1, wherein said ring is formed of a plurality of members connected together at opposite ends thereof in end-to-end manner.

16. An apparatus as claimed in claim 1, wherein said ring is formed of a plurality of ring members connected together, and said annular bore is formed by annular grooves in said ring members.

17. An apparatus as claimed in claim 1, wherein said ring is rectangular.

18. An apparatus as claimed in claim 1, wherein said ring is circular.

19. An apparatus as claimed in claim 1, wherein said ring is formed of graphite.

* * * * *